United States Patent [19]

Woodrum

[11] Patent Number: 4,489,111

[45] Date of Patent: Dec. 18, 1984

[54] BEADED TRIMMED SATIN CHRISTMAS ORNAMENT

[76] Inventor: Dorothy B. Woodrum, 3377 Ewa Beach Dr., Las Vegas, Nev. 89122

[21] Appl. No.: 573,395

[22] Filed: Jan. 24, 1984

[51] Int. Cl.[3] ..... A47G 33/08

[52] U.S. Cl. ..... 428/11; 206/575; D11/121

[58] Field of Search ..... 428/4–11; 156/63; D11/121; 206/457, 575

[56] References Cited

U.S. PATENT DOCUMENTS 424,916 4/1890 Wilmsen ..... 428/11 X 3,622,426 11/1971 O'Sullivan ..... 428/4 X

OTHER PUBLICATIONS p. 15 of the 1970 Catalog "A complete line of Hobby Craft Kits for the Fun of It" Arrow Handicraft Corp. Chicago, Illinois 60609.

p. 144, American Home, Oct. 1972, vol. 75, No. 10.

*Primary Examiner*—Henry F. Epstein

[57] ABSTRACT

The invention is a beaded, trimmed satin Christmas ornament, that includes variously-shaped and colored sequins and beads pinned on a Christmas ball, to form a pleasing design.

1 Claim, 13 Drawing Figures

BEADED TRIMMED SATIN CHRISTMAS ORNAMENT

This invention relates generally to Christmas ornaments, such as are usually hung up on Christmas trees. More specifically, it relates to a kit for making such ornaments.

It is an established tradition to hang up various kinds of ornaments upon Christmas trees, which may comprise either candy canes, cookies, icicles or ropes made from shiny strips of metal foil, as well as shiny metal foil balls, that may additionally include various attractive designs painted thereupon. Until now, these decorative balls have been commercially manufactured, so that their designs are limited to the selection of design patterns made by the manufacturers.

It is an object of the present invention to provide a kit whereby any person may design and make his own Christmas ornament balls, so that the decorative pattern thereupon is the individual's own creation.

Another object is to provide a kit wherein an endless, unlimited number of different Christmas ornaments can be originated.

Yet another object is to provide a Christmas ornament, that is more durable against breakage than a conventional Christmas ornament ball molded of the usual thin metal foil.

Other objects are to provide a Christmas ornament, which is simple in design, inexpensive to manufacture, rugged in construction, easy to use, and efficient in operation.

These, and other objects, will be readily evident, upon a study of the following specification, and the accompanying drawing, wherein:

FIGS. 1*a*, 1*b* and 1*c*, in combination, are views of typical sample components, that comprise a kit to make beaded, trimmed satin Christmas ornaments; FIG. 1*a* showing pins, FIG. 1*b* showing sequins and FIG. 1*c* showing beads;

Figures 1A, 1B, 1C, 2, 3, 4, 5, 6, 7, 8, 9, 10, 11:
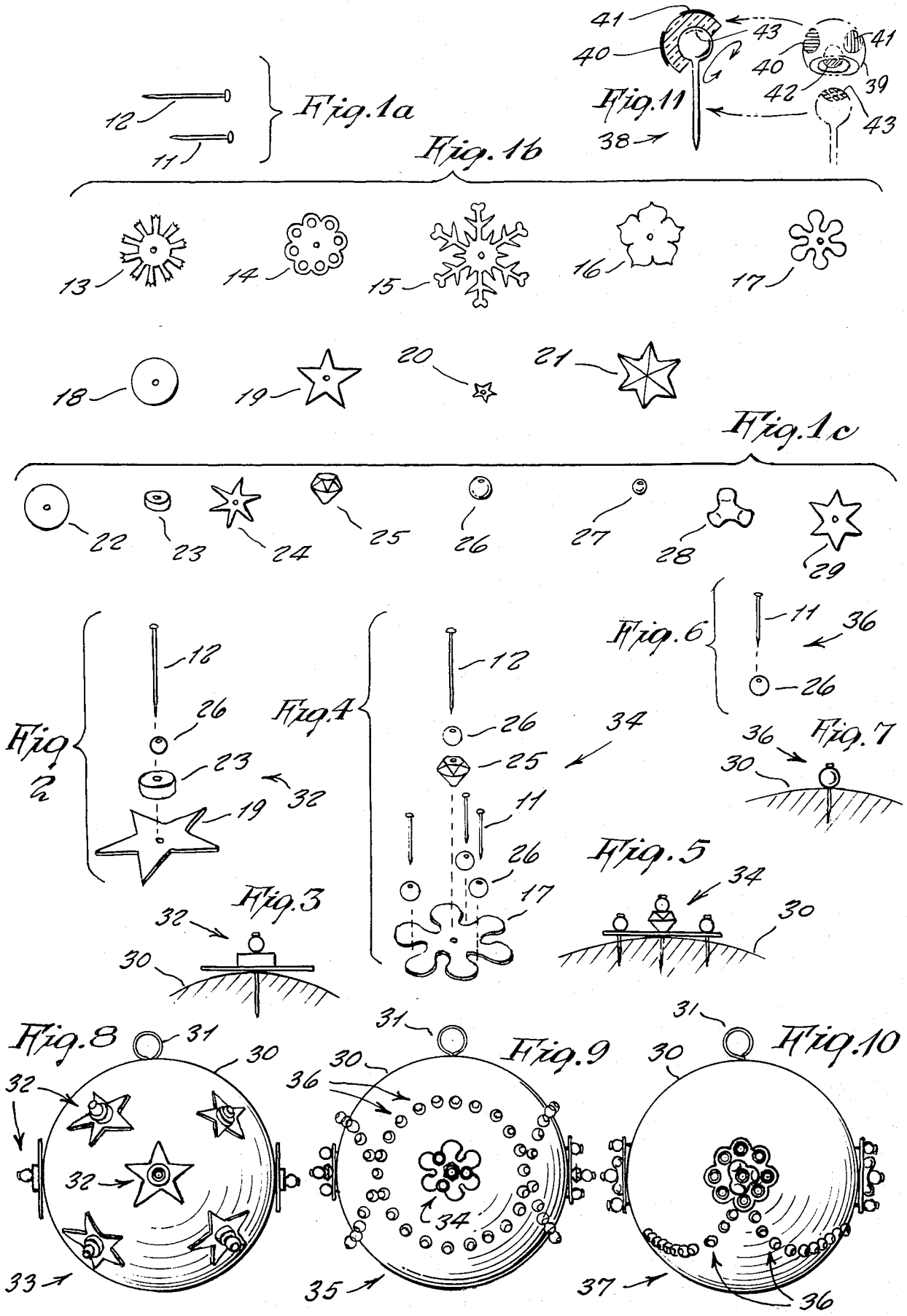
FIG. 2 is an exploded perspective view of some of the components for forming one design of decoration unit.
FIG. 3 is a side elevational view thereof, shown assembled.
FIG. 4 is a view similar to FIG. 2, shown using different components.
FIG. 5 is a side elevational view thereof, shown assembled.
FIG. 6 is yet another view similar to FIG. 2, shown using yet other components.
FIG. 7 is a side elevational view thereof, shown assembled.
FIG. 8 is a side elevational view of an assembled Christmas ornament ball, showing one design.
FIG. 9 is a similar view, showing another design.
FIG. 10 is a similar view, showing yet another design thereof.
FIG. 11 illustrates another design of the pin.

Referring now to the drawing in greater detail, the kit includes one-half inch short pins 11, and three-quarter inch long pins 12, and are all made of metal, being pointed at one end, and having an enlarged head at the other end.

The sequins are stamped out of flat, reflective metal foil or other suitable material, in order to radiate light; the sequins being made in an assortment of various different colors. Each sequin has a central hole for receiving one of the above indicated pins, and both larger and smaller sequins are included in the kit, the sequins having various different-shaped peripheral contours. As shown in FIG. 1*b*, these include geometric-shaped sequins 13 through 21, some of whose design resemble a toothed wheel, a snow flake, a flower blossom, a star, a starfish or the like. The sequin 14 includes a circular row of holes near its edge, for receiving pins. All of the sequins may be easily punctured by the pins, if other pin holes may be needed.

The beads are preferably molded of plastic, so that they are three dimensional, by including substantial thickness. FIG. 1*c* illustrates beads 22 through 29; beads 22 and 23 being in the shape of circular buttons, while beads 24 and 29 are starfish-shaped, and beads 26 and 27 are pearl-shaped in different sizes. The beads are provided in an assortment of different colors, as well as being clear.

The kit also includes a supply of Christmas balls 30, that are approximately two and one-quarter inches in diameter, and which are made from a solid polystyrene, so that the pins may be easily pushed thereinto, and which are covered with a trimmed satin fiber material in various lustrous colors. Each ball 30 includes a wire loop 31, for hanging on a tree.

In FIGS. 2 and 3, a selection of pin, sequin and beads are shown, and assembled together, so as to form a decoration unit 32, and which is used in the Christmas ball design 33 shown in FIG. 8.

In FIGS. 4 and 5, a selection of pins, sequin and beads are shown and assembled together, so as to form a decoration unit 34, and which is used in Christmas ball design 35 shown in FIG. 9.

In FIGS. 6 and 7, a selection of pin and pearl bead are shown, and assembled together, so as to form a decoration unit 36, and which is used to form the draping swag in the Christmas ball design 37, shown in FIG. 10, and the circular frames in FIG. 9.

It is apparent that the components of the kit may be variously assembled, in designs wherein the differences are limited only by a person's own imagination.

In a modified construction of pin 38, shown in FIG. 11, a rotatable cap 39 of transparent plastic is snap-fitted on the spherical head of the pin; various areas 40, 41 and 42 of the cap being tinted in different colors, which, when selectively aligned over yet another color area 43, on the top of the pin head, produce a secondary color effect, for possibly matching the color schemes of the sequins and beads that are being used. The cap, in a level position, aligns a clear portion thereof with the top of the pin, so as not to produce a secondary color.

While various changes may be made in the detail construction, it is understood that such changes will be within the spirit and scope of the present invention, as is defined by the appended claims.

What I now claim is:

1. A kit for making beaded, trimmed satin Christmas ornaments, comprising, in combination, a plurality of solid polystyrene balls covered with trimmed satin fibers of various lustrous colors, a wire loop attached to each said ball for hanging on a Christmas tree, and a plurality of separate components for being selectively mounted on each said ball; said separate components comprising a plurality of pins, a plurality of beads and a plurality of sequins of various shapes, sizes and colors; and at least some of said pins each having a spherical head, a colored area on the top of said spherical head, and a hollow rotatable cap snap-fitted on said head, said cap being made of transparent plastic and having an opening at the bottom thereof for receiving said pin head, a circular row of areas around a side of said cap each being tinted in a different color for selective alignment with said colored area on said pin head top for producing a selective secondary color therewith, and an area on said cap which is opposite said opening being left untinted clear.

* * * * *